US010011928B2

(12) United States Patent
Lonati et al.

(10) Patent No.: US 10,011,928 B2
(45) Date of Patent: Jul. 3, 2018

(54) METHOD FOR CLOSING AUTOMATICALLY AN AXIAL END OF A TUBULAR MANUFACTURE AND FOR UNLOADING IT IN AN INSIDE-OUT CONFIGURATION, AND APPARATUS FOR PERFORMING THE METHOD

(71) Applicants: Lonati S.P.A., Brescia (IT); Francesco Lonati, San Felice del Benaco (IT); Matteo Lonati, Brescia (IT)

(72) Inventors: Ettore Lonati, Botticino (IT); Fausto Lonati, Brescia (IT); Tiberio Lonati, Brescia (IT)

(73) Assignee: LONATI S.p.A., Brescia (IT)

( * ) Notice: Subject to any disclaimer, the term of this patent is extended or adjusted under 35 U.S.C. 154(b) by 288 days.

(21) Appl. No.: 14/760,958

(22) PCT Filed: Dec. 11, 2013

(86) PCT No.: PCT/EP2013/076192
§ 371 (c)(1),
(2) Date: Jul. 14, 2015

(87) PCT Pub. No.: WO2014/111206
PCT Pub. Date: Jul. 24, 2014

(65) Prior Publication Data

US 2015/0354108 A1 Dec. 10, 2015

(30) Foreign Application Priority Data

Jan. 16, 2013 (IT) ..... MI2013A0050

(51) Int. Cl.
*D04B 15/88* (2006.01)
*D04B 9/02* (2006.01)
(Continued)

(52) U.S. Cl.
CPC ..... *D04B 15/88* (2013.01); *D04B 9/02* (2013.01); *D04B 9/40* (2013.01); *D04B 9/46* (2013.01); *D04B 15/02* (2013.01); *D05B 23/009* (2013.01)

(58) Field of Classification Search
CPC . D04B 15/88; D04B 9/02; D04B 9/40; D04B 9/46; D04B 15/02; D04B 9/56;
(Continued)

(56) References Cited

U.S. PATENT DOCUMENTS 3,306,080 A * 2/1967 Rossler ..... D04B 15/88 66/149 R
3,473,350 A * 10/1969 Scheel ..... D04B 15/92 66/149 S
(Continued)

FOREIGN PATENT DOCUMENTS

CN 1961110 A 5/2007
CN 101243223 A 8/2008
(Continued)

OTHER PUBLICATIONS

Chinese Office Action related to CN2013870543 dated Sep. 1, 2016 (5 pgs.).
(Continued)

*Primary Examiner* — Griffin Hall
(74) *Attorney, Agent, or Firm* — Husch Blackwell LLP

(57) ABSTRACT

A method for closing automatically an axial end of a tubular manufacture and for unloading it in inside-out configuration comprising a step of positioning the manufacture, in a right-way-out configuration, at a sewing or linking station, arranged so that its axis is substantially vertical and so that it hangs, by means of a first axial end to be closed by sewing or linking, from an annular handling device. Then a step is performed for inserting the manufacture, retained by the
(Continued)

Figure 1:
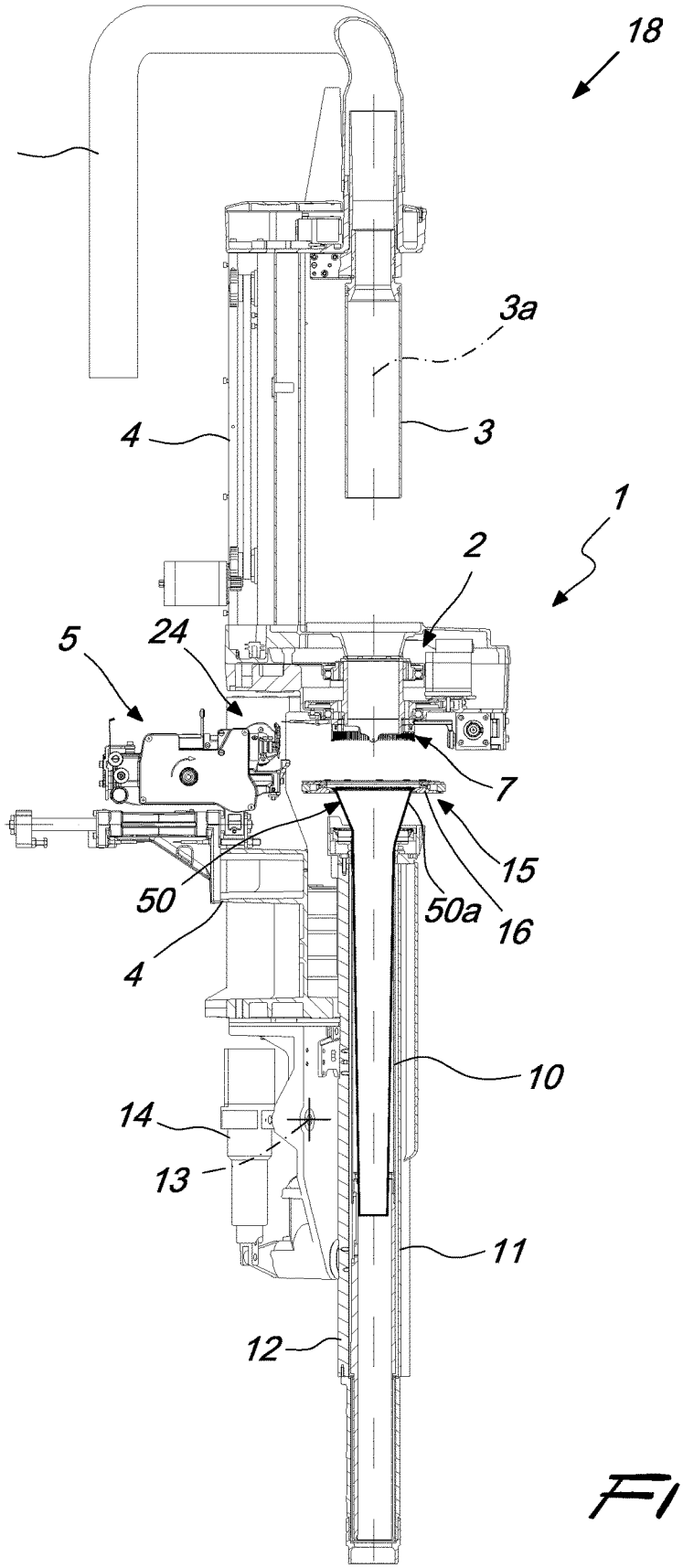

handling device, into an upper reversing tube that is or can be positioned, with its lower axial end, above the handling device. A step of closing the first axial end of the manufacture by sewing or linking is then performed. Then a step of disengaging the manufacture from the handling device and a step of removing the manufacture through the upper axial end of the upper reversing tube are performed.

3 Claims, 20 Drawing Sheets

(51) Int. Cl.

| | |
|---|---|
| ***D04B 9/40*** | (2006.01) |
| ***D04B 9/46*** | (2006.01) |
| ***D05B 15/02*** | (2006.01) |
| ***D05B 23/00*** | (2006.01) |
| ***D04B 15/02*** | (2006.01) |

(58) Field of Classification Search
CPC .... D04B 15/92; D05B 23/006; D05B 23/007; D05B 23/009; D05B 23/00; D05B 7/00; D05B 35/00; D05B 35/02; D05B 35/062
USPC .... 66/91, 147, 148, 149 R, 150, 149 S, 152, 66/153
See application file for complete search history.

(56) References Cited

U.S. PATENT DOCUMENTS

| | | | | | |
|---|---|---|---|---|---|
| 4,242,891 | A * | 1/1981 | Gradi | D04B 15/92 | 66/149 S |
| 4,407,145 | A * | 10/1983 | Lonati | D04B 15/92 | 66/14 |
| 5,052,196 | A * | 10/1991 | Turini | D04B 15/92 | 66/149 S |
| 5,231,856 | A * | 8/1993 | Lonati | D04B 15/92 | 66/147 |
| 5,349,913 | A | 9/1994 | Schramayr et al. | | |
| 5,511,501 | A * | 4/1996 | Bell | B65G 47/1478 | 112/470.15 |
| 5,560,225 | A * | 10/1996 | Salucci | D04B 15/92 | 66/148 |
| 5,570,591 | A * | 11/1996 | Frullini | D04B 9/56 | 66/148 |
| 5,924,309 | A * | 7/1999 | Conti | D04B 9/56 | 66/148 |
| 6,105,399 | A * | 8/2000 | Frullini | D04B 9/56 | 66/147 |
| 6,158,252 | A * | 12/2000 | Conti | D04B 9/56 | 66/148 |
| 6,164,091 | A * | 12/2000 | Frullini | D04B 9/40 | 66/148 |
| 6,282,925 | B1 * | 9/2001 | Ando' | D04B 15/92 | 66/148 |
| 6,341,570 | B2 * | 1/2002 | Fujiwara | D04B 15/06 | 112/470.08 |
| 6,381,991 | B2 * | 5/2002 | Ando' | D04B 9/56 | 66/148 |
| 6,389,849 | B1 * | 5/2002 | Conti | D04B 9/40 | 66/148 |
| 6,698,250 | B2 * | 3/2004 | Lonati | D04B 9/10 | 66/148 |
| 6,826,930 | B2 * | 12/2004 | Frullini | D04B 9/40 | 66/148 |
| 7,025,011 | B2 * | 4/2006 | Jordan | D05B 23/007 | 112/470.08 |
| 7,044,071 | B2 * | 5/2006 | Jordan | D05B 23/007 | 112/470.08 |
| 7,107,797 | B2 * | 9/2006 | Frullini | D04B 9/02 | 66/148 |
| 7,878,029 | B2 * | 2/2011 | Lonati | D04B 9/06 | 66/149 S |
| 7,900,483 | B2 * | 3/2011 | Conti | D04B 15/02 | 66/148 |
| 7,908,987 | B2 * | 3/2011 | Grassi | D05B 23/009 | 112/470.08 |
| 7,954,343 | B2 * | 6/2011 | Lonati | D04B 9/02 | 66/148 |
| 7,975,513 | B2 * | 7/2011 | Lonati | D04B 9/40 | 66/148 |
| 8,028,546 | B2 * | 10/2011 | Lonati | D04B 15/02 | 66/148 |
| 8,443,633 | B1 * | 5/2013 | Inli | D04B 1/108 | 66/148 |
| 8,833,108 | B2 * | 9/2014 | Lonati | D04B 9/10 | 66/18 |
| 9,365,961 | B2 * | 6/2016 | Lonati | D04B 15/92 | |
| 9,365,962 | B2 * | 6/2016 | Lonati | D04B 9/10 | |
| 9,481,952 | B2 * | 11/2016 | Lonati | D04B 9/10 | |
| 9,562,307 | B2 * | 2/2017 | Conti | D04B 9/40 | |
| 9,617,672 | B2 * | 4/2017 | Lonati | D05B 35/00 | |
| 2004/0154341 | A1 * | 8/2004 | Conti | D04B 9/40 | 66/149 S |
| 2004/0168478 | A1 * | 9/2004 | Conti | D05B 7/00 | 66/147 |
| 2004/0244431 | A1 * | 12/2004 | Magni | D04B 9/40 | 66/147 |
| 2005/0115279 | A1 * | 6/2005 | Magni | D04B 9/40 | 66/148 |
| 2007/0101770 | A1 | 5/2007 | Grassi et al. | | |
| 2009/0049867 | A1 | 2/2009 | Magni et al. | | |

FOREIGN PATENT DOCUMENTS

| | | | | |
|---|---|---|---|---|
| EP | 0697479 | | 2/1996 | |
| IT | MI913258 | | 6/1993 | |
| JP | 5580501 | A | 6/1980 | |
| JP | 2004143614 | | 5/2004 | |
| JP | 2011514940 | | 5/2011 | |
| JP | 2011514942 | | 5/2011 | |
| WO | WO 02/070801 | | 9/2002 | |
| WO | 2007110894 | | 10/2007 | |
| WO | WO 2008/028576 | | 3/2008 | |
| WO | WO 2008028576 | A8 * | 5/2008 | D04B 9/40 |
| WO | WO 2009/144049 | | 12/2009 | |

OTHER PUBLICATIONS

Italian Search Report and translation dated Nov. 4, 2013, for Pat No. MI20130050.
PCT International Search Report dated Mar. 25, 2014.
English translation of a Japanese Office Action related to JP2015-552017, dated Aug. 1, 2017 (6 pgs.).

* cited by examiner

METHOD FOR CLOSING AUTOMATICALLY AN AXIAL END OF A TUBULAR MANUFACTURE AND FOR UNLOADING IT IN AN INSIDE-OUT CONFIGURATION, AND APPARATUS FOR PERFORMING THE METHOD

The present invention relates to a method for closing automatically an axial end of a tubular manufacture and for unloading it in an inside-out configuration and to an apparatus for performing the method.

Methods and apparatuses are known for the automated closing of an axial end of a tubular manufacture, particularly of a sock, at the end of its productive cycle generally performed by means of a circular hosiery knitting machine or the like.

In many of these methods and apparatuses, the closing of an axial end of the manufacture is performed by sewing or linking with the manufacture in an inside-out configuration so that the sewing or linking is virtually invisible on the right side of the manufacture. At the end of the sewing or linking process, the manufacture is disengaged and moved away from the apparatus, performing also its reversing, i.e., its transition to the right-way-out configuration.

In particular, WO2009/112346 in the name of the same Applicant describes a method and an apparatus that allow closing an axial end of a tubular manufacture. The apparatus described in this patent comprises a sewing or linking station in which a handling device is positioned which is adapted to retain the manufacture, arranged with its axis substantially vertically, hung from said handling apparatus by means of a first axial end, which constitutes the axial end to be closed by sewing or linking. The handling device comprises an annular body that can be engaged with said axial end of the manufacture. The annular body is composed of two annular portions that are mutually pivoted around a diametrical axis of the ring-like body and one of these two annular portions can move rotatably about the diametrical axis with respect to the other annular portion so as to pass from a coplanar position to a position facing the other annular portion. The ring-like body is provided with a plurality of spikes which, when the two annular portions of the annular body are coplanar, extend parallel to the axis of the annular body and are distributed along the circumferential extension of the annular body. When an annular portion is arranged so as to face the other annular portion of the annular body, the spikes of one annular portion face and are aligned with the spikes of the other annular portion of the annular body.

In the apparatus described in WO2009/112346, to which reference is made for the sake of completeness of the description, the tubular manufacture, at the end of its production, is picked up from the circular hosiery knitting machine that has produced it and is transferred to the handling device arranged at the sewing or linking station. More particularly, the loops of knitting of the row of knitting formed last are each transferred by a needle of the hosiery knitting machine to a spike of the annular body of the handling device with the two annular portions in a coplanar position. The manufacture, which hangs with its axial end to be closed from the handling device and extends below it, is aspirated into a lower reversing tube, having a substantially vertical axis, that is supported below the handling device and faces with its upper axial end the annular body of the handling device. In this condition, the manufacture is in the right-way-out configuration. The lower reversing tube is then lifted and passed through the annular body of the handling device, turning up the tubular manufacture on the external lateral surface of said lower reversing tube. In this manner, the manufacture is still engaged by means of its first axial end with the spikes of the annular body of the handling device, but extends, in an inside-out configuration, above the same annular body of the handling device. An annular portion of the annular body of the handling device is rotated about the diametrical axis so as to face with its spikes the spikes of the other annular portion and the loops carried by the spikes of one annular portion are passed onto the spikes of the other annular portion, so that each one of said spikes carries two loops of knitting. A sewing or linking head joins the various pairs of loops carried by the spikes of an annular portion and the manufacture is disengaged from the spikes of the handling device and aspirated into the lower reversing tube through its lower axial end that is above the annular body of the handling device. Due to this aspiration, the manufacture, the first axial end of which has been closed, passes again into the right-way-out configuration and is moved away, in this configuration, from the apparatus used for closing said axial end.

Generally, it is preferred that the manufacture, at the end of its production cycle and of the closure of one of its axial ends, is in the right-way-out configuration because in this condition it can be subjected to the various finishing processes and then packaged.

However, in some cases it is required that the manufacture is unloaded from the apparatus used for closing one of its axial ends in the inside-out configuration, so that it can be subjected to at least part of the finishing operations in the inside-out configuration. This need is particularly felt, for example, for hosiery or other tubular manufactures that bear designs or particular patterns that leave tails of yarn on the reverse side of the manufacture which, during the finishing operations, might be pushed to exit from the right side of the manufacture, being thus visible on the finished manufacture.

There are similar needs when the finishing operations are particularly intense with respect to the yarns or the knitting performed and for this reason, if applied on the right side of the manufacture, might damage it or alter its look.

The aim of the present invention is to meet this need by devising a method that allows performing the automated closure of an axial end of a tubular manufacture and its unloading in an inside-out configuration.

Within this aim, an object of the invention is to propose a method that can be performed in a relatively simple manner and with high reliability and precision.

Another object of the invention is to provide an apparatus for performing the method according to the invention that is relatively simple to provide.

Yet another object of the invention is to devise an apparatus for performing the method according to the invention that can be derived, with modifications that are easy to provide, from known apparatuses, for example of the type described in WO2009/112346.

A further object of the invention is to propose a method and an apparatus that allow closing an axial end of a tubular manufacture and unloading it in an inside-out configuration in an economically competitive manner.

This aim and these and other objects that will become more apparent hereinafter are achieved by a method for closing an axial end of a tubular manufacture and for unloading it in an inside-out configuration, comprising sequentially:

a step of positioning the manufacture, in a right-way-out configuration, at a sewing or linking station, arranged so that its axis is substantially vertical and hangs, by means of a first axial end to be closed by sewing or linking, from an annular handling device, said manufacture extending below said handling device;

a step of inserting the manufacture, retained by said handling device, into an upper reversing tube that is or can be positioned, with its lower axial end, above said handling device for the passage of the manufacture through said handling device, said passage arranging the manufacture in the inside-out configuration;

a step of closing said first axial end of the manufacture by sewing or linking;

a step of disengaging the manufacture from said handling device;

a step of moving away the manufacture through the upper axial end of said upper reversing tube.

Figure 1A:
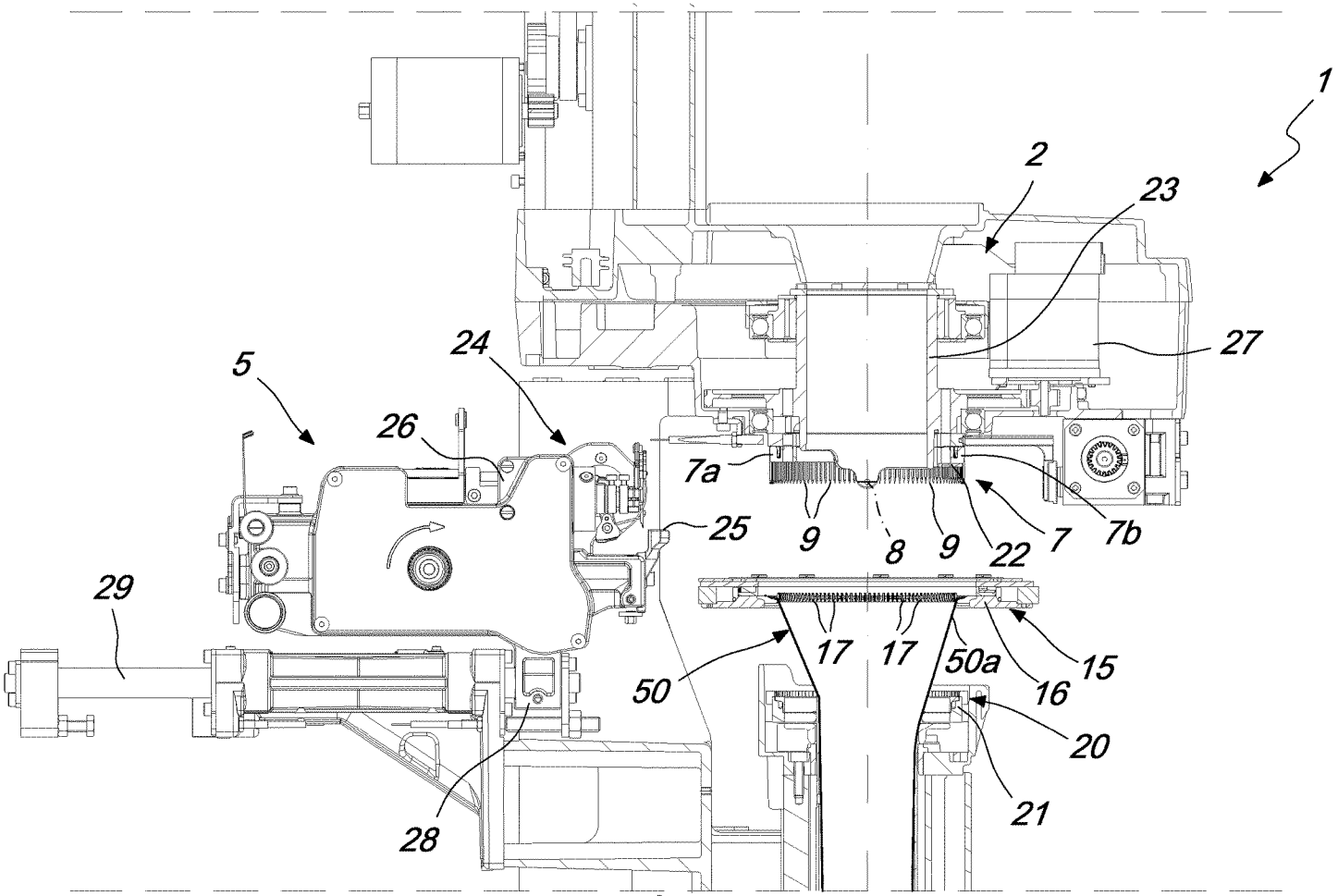
Figure 2:
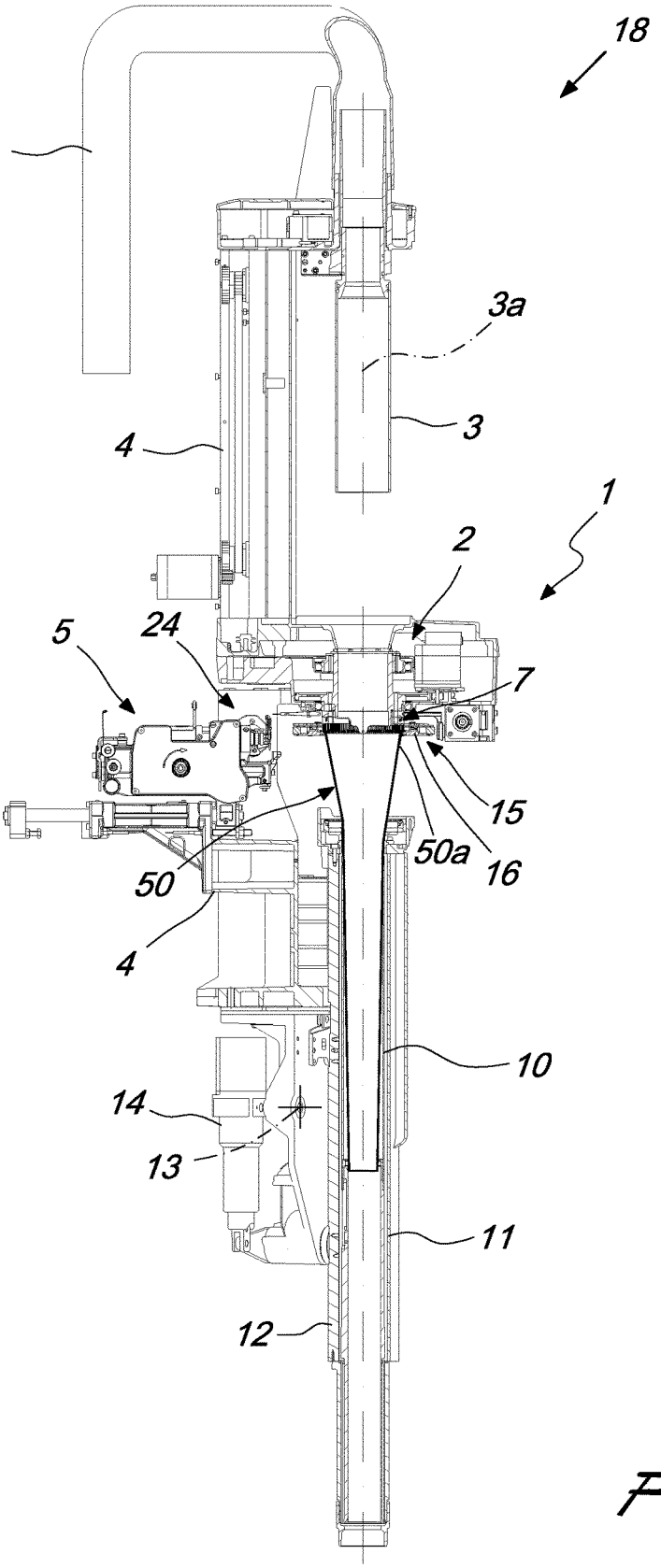
Figure 2A:
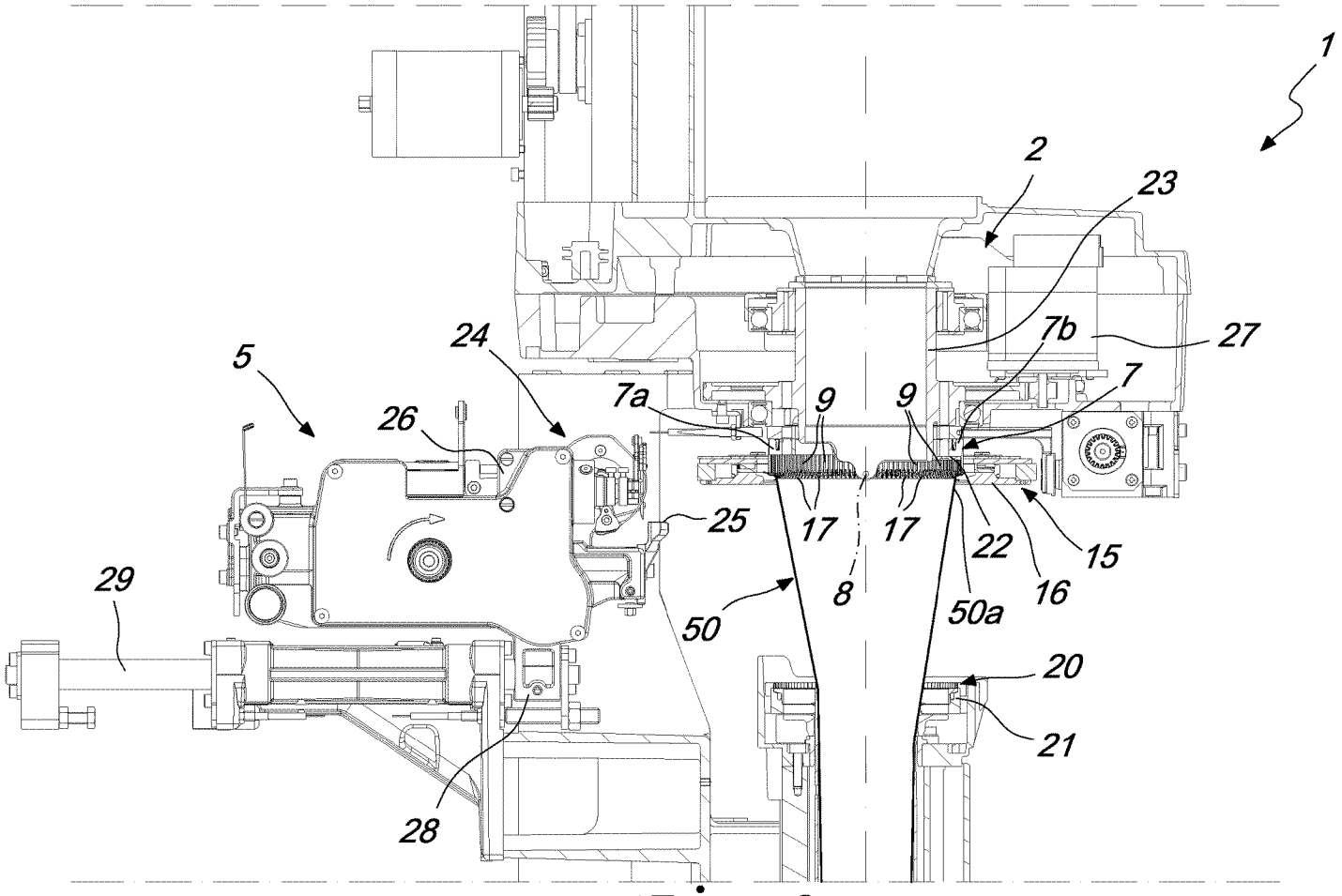
Figure 3:
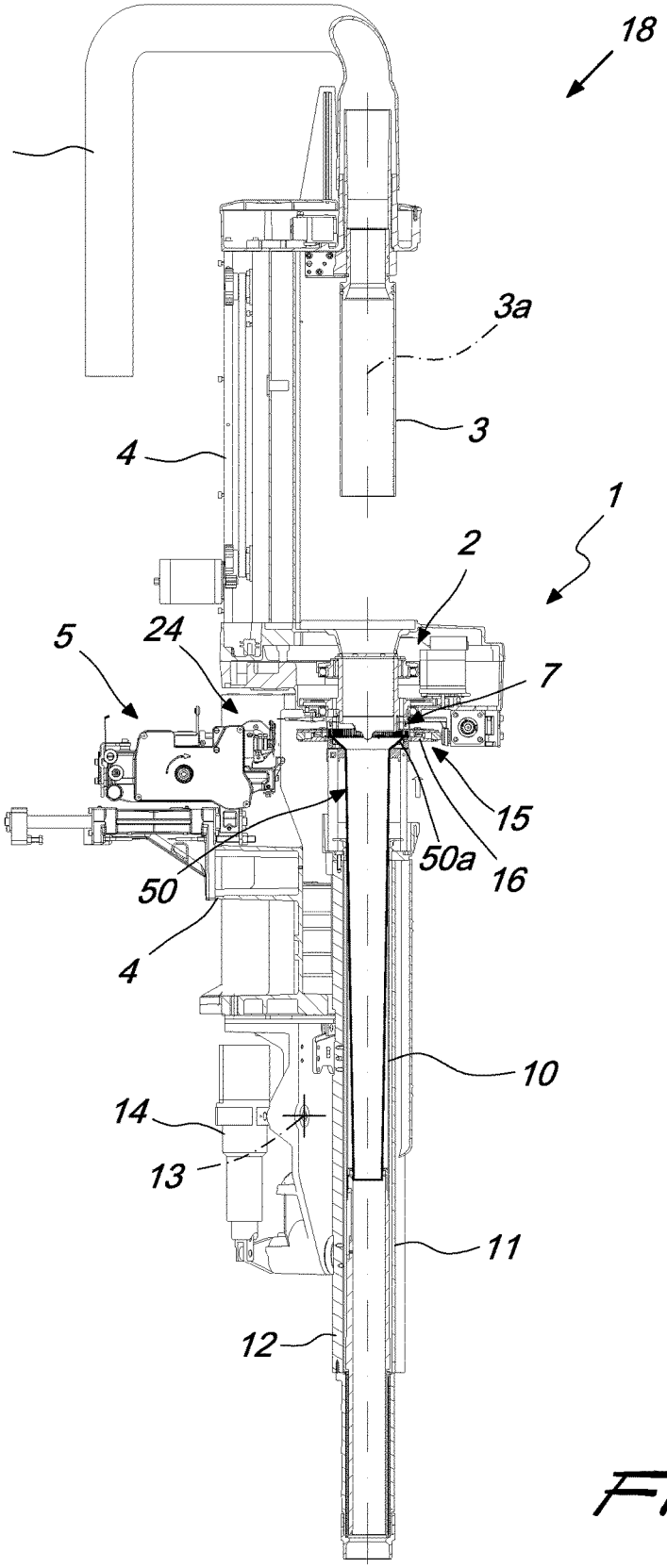
Figure 3A:
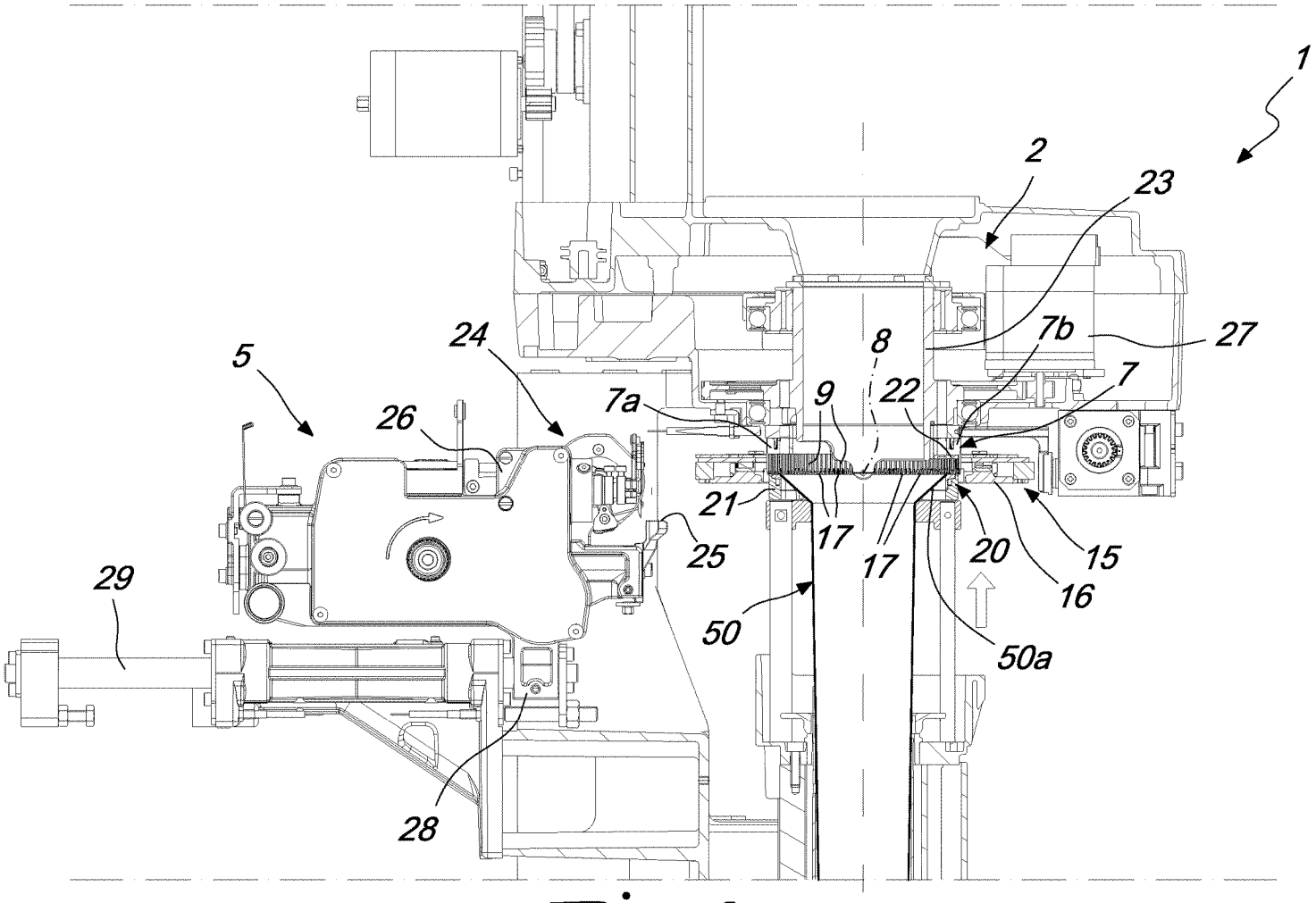
Figure 4:
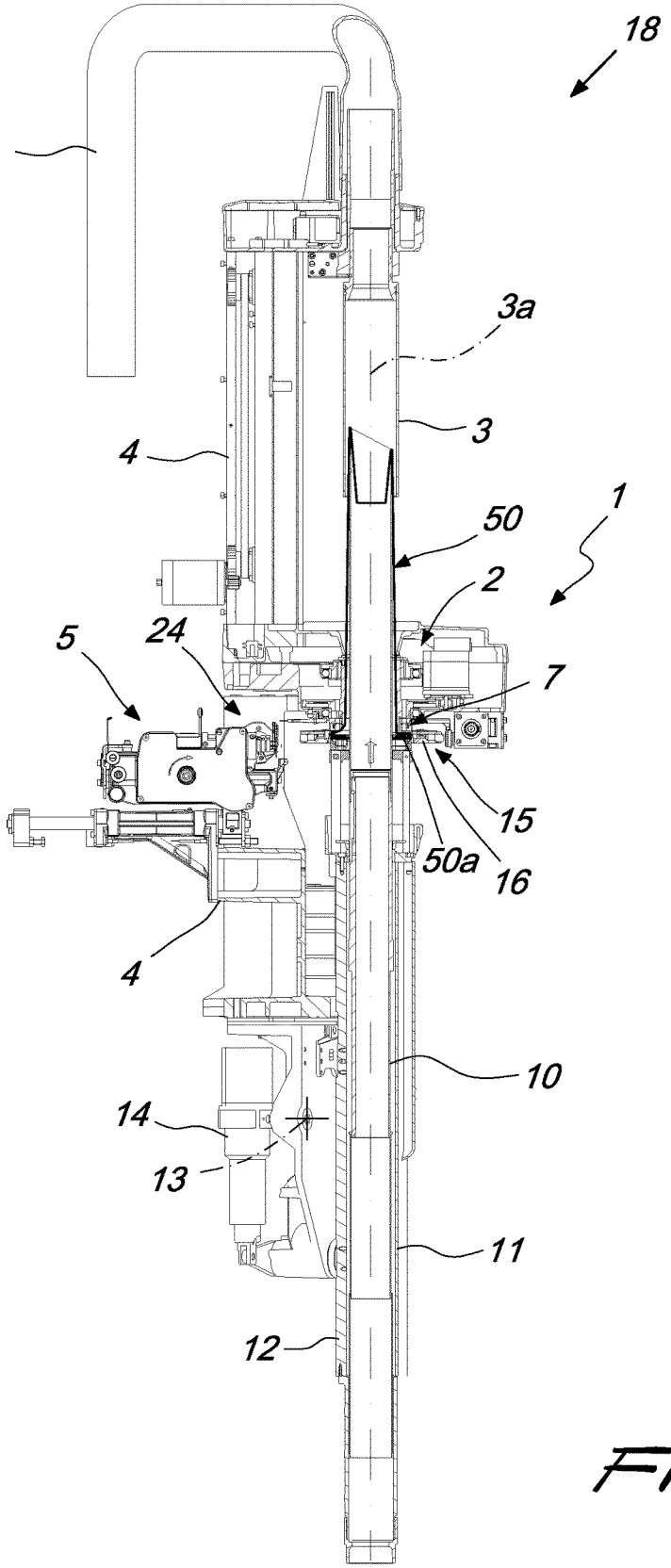
Figure 4A:
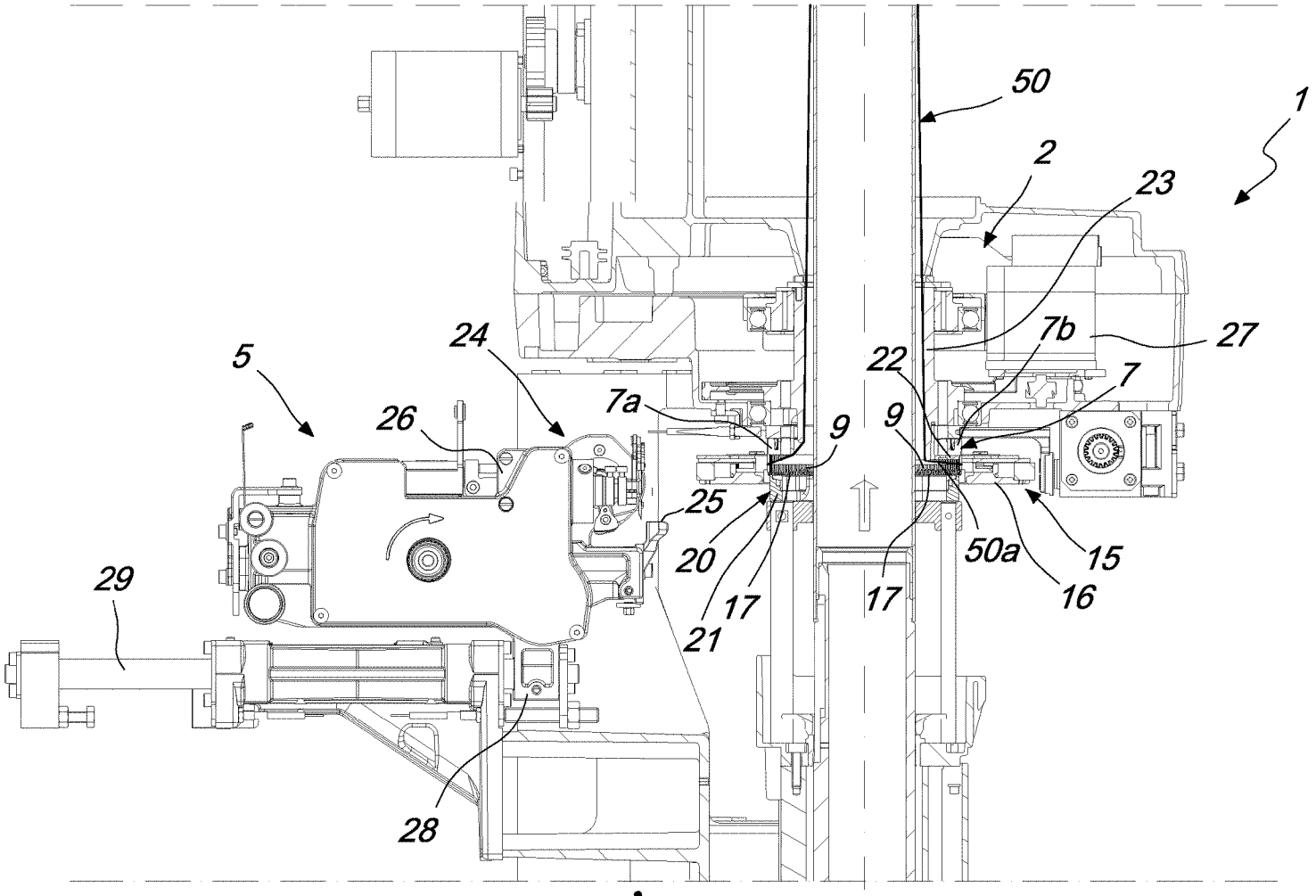
Figure 5:
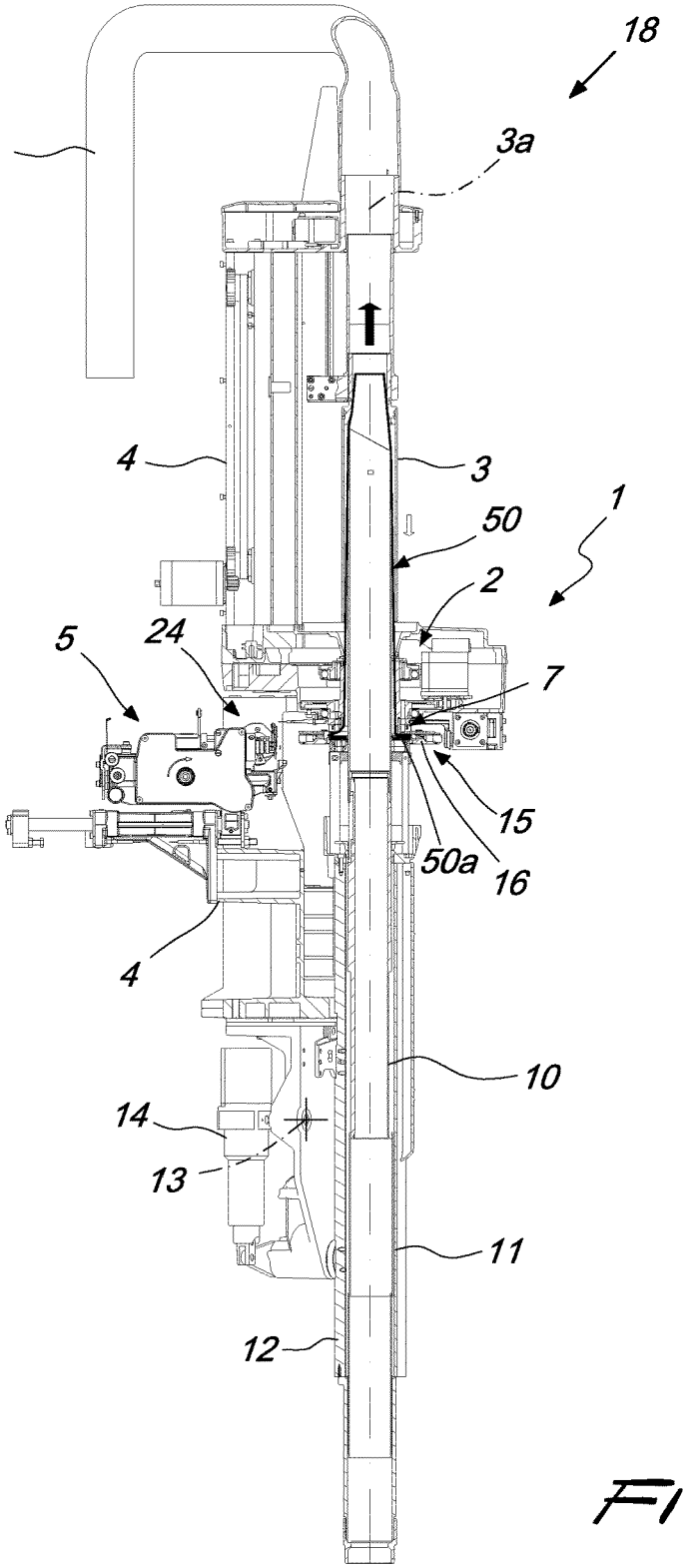
Figure 5A:
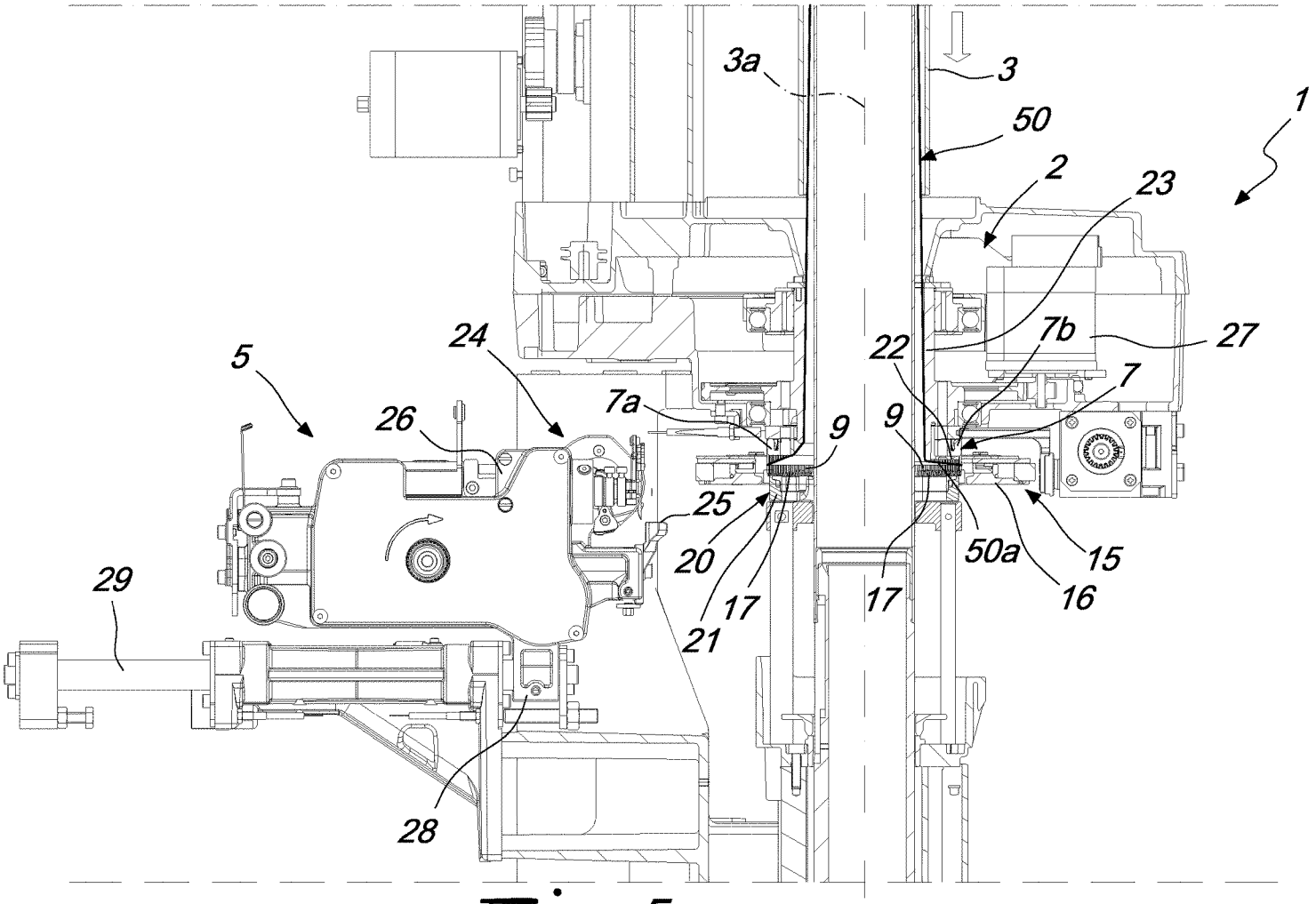
Figure 6:
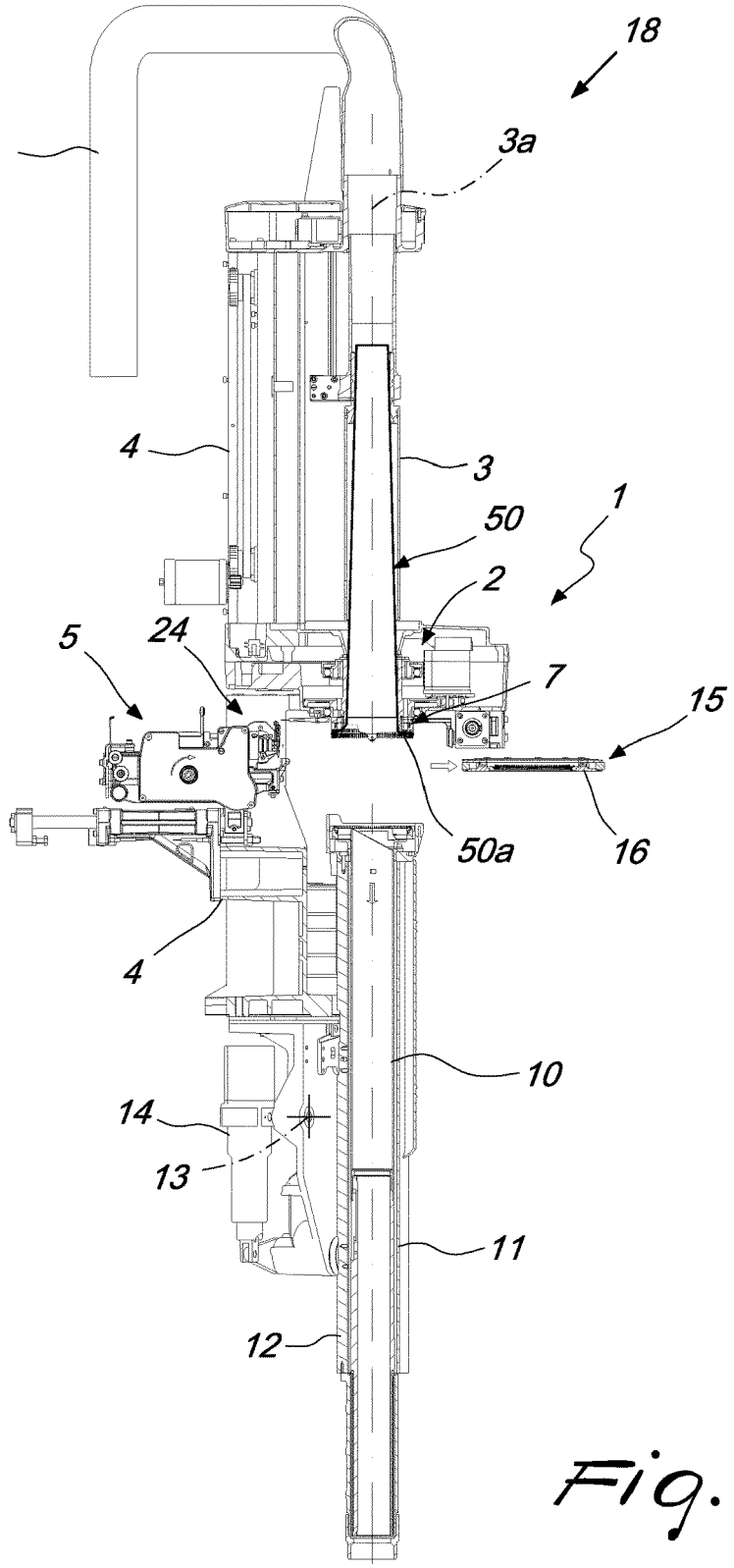
Figure 6A:
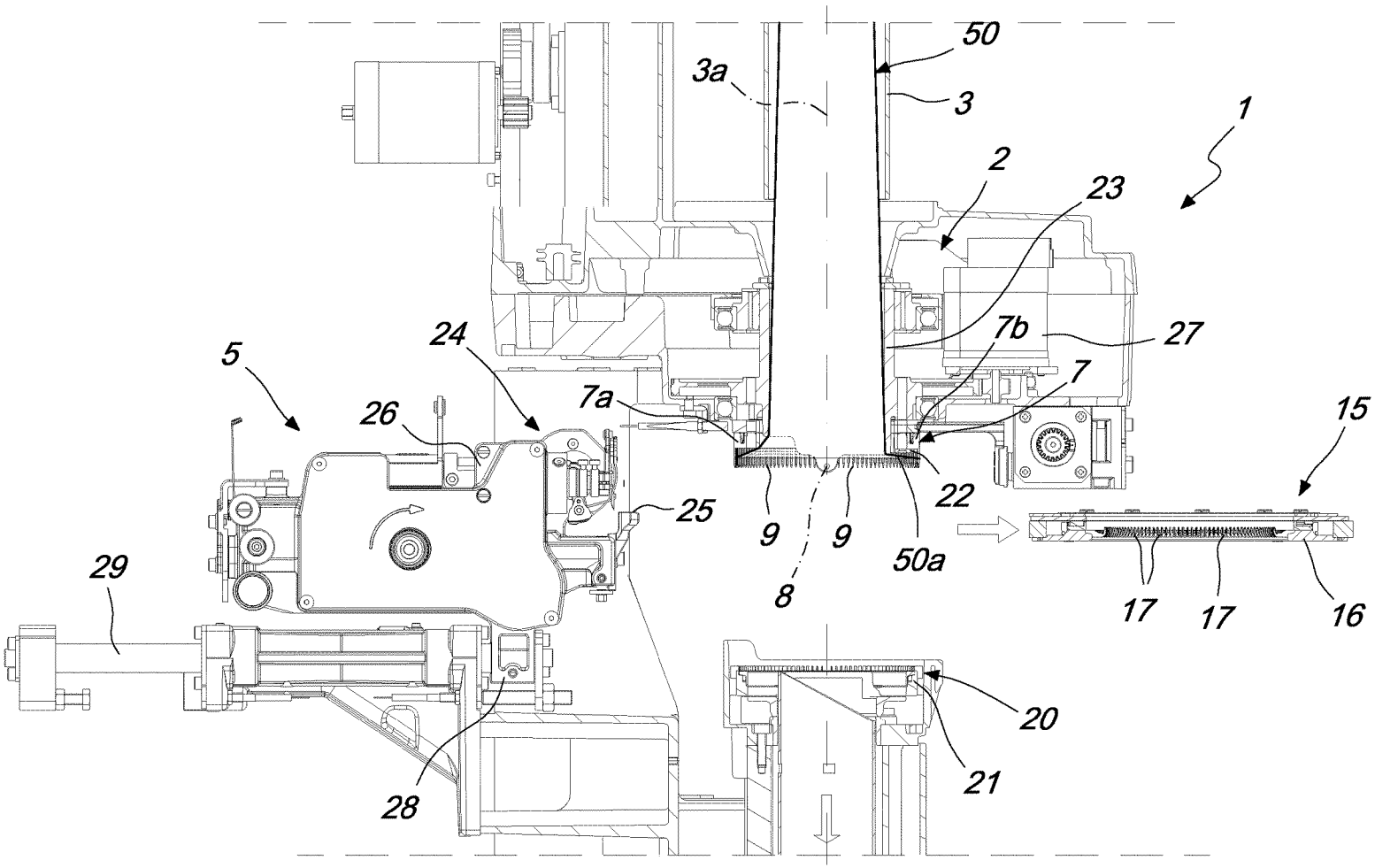
Figure 7:
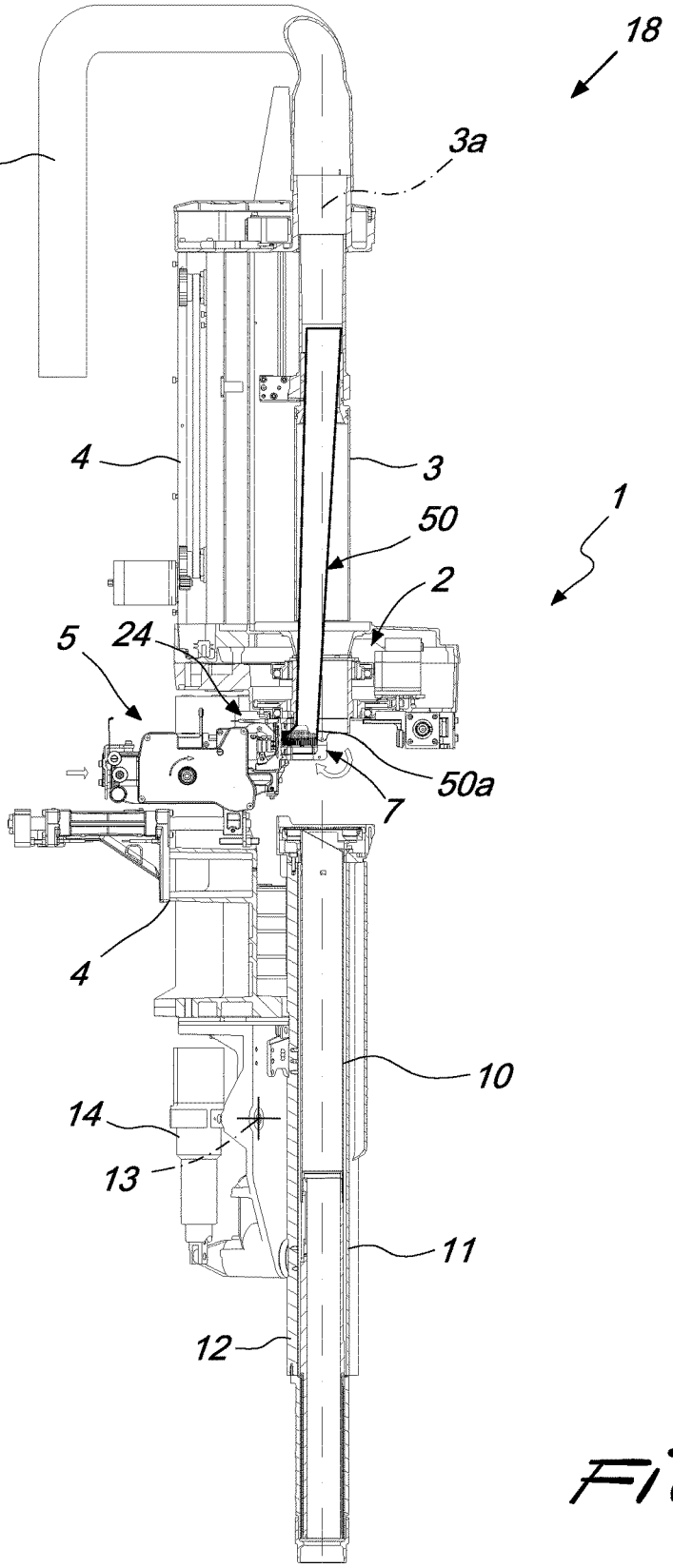
Figure 7A:
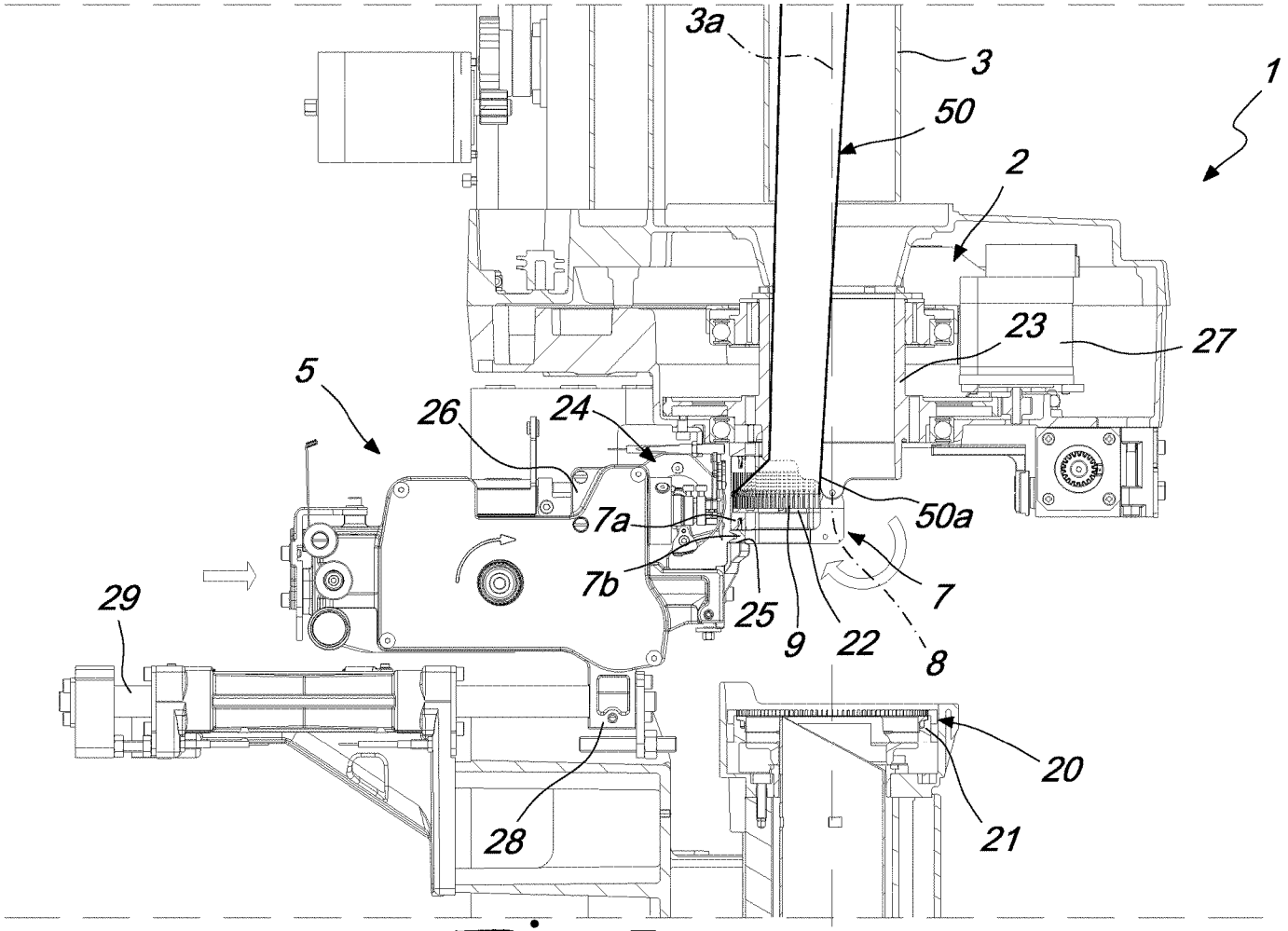
Figure 8:
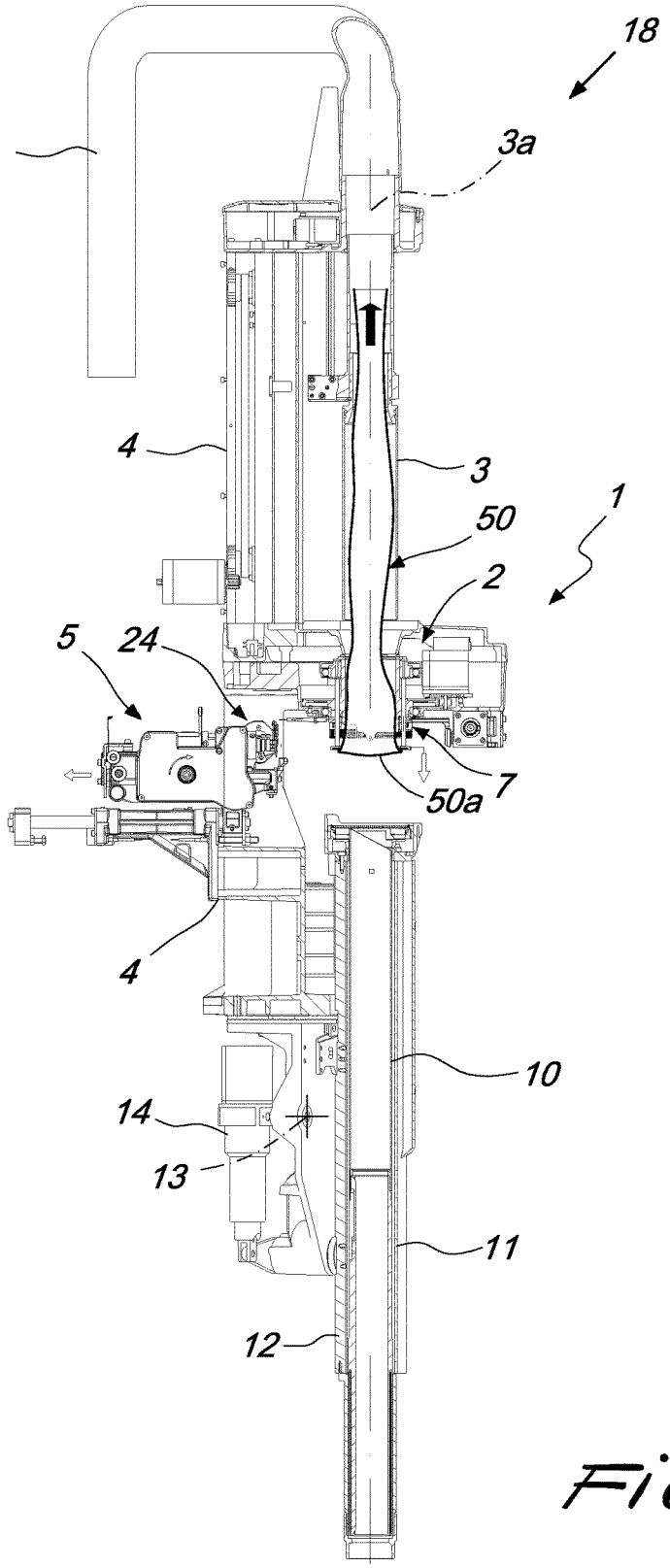
Figure 8A:
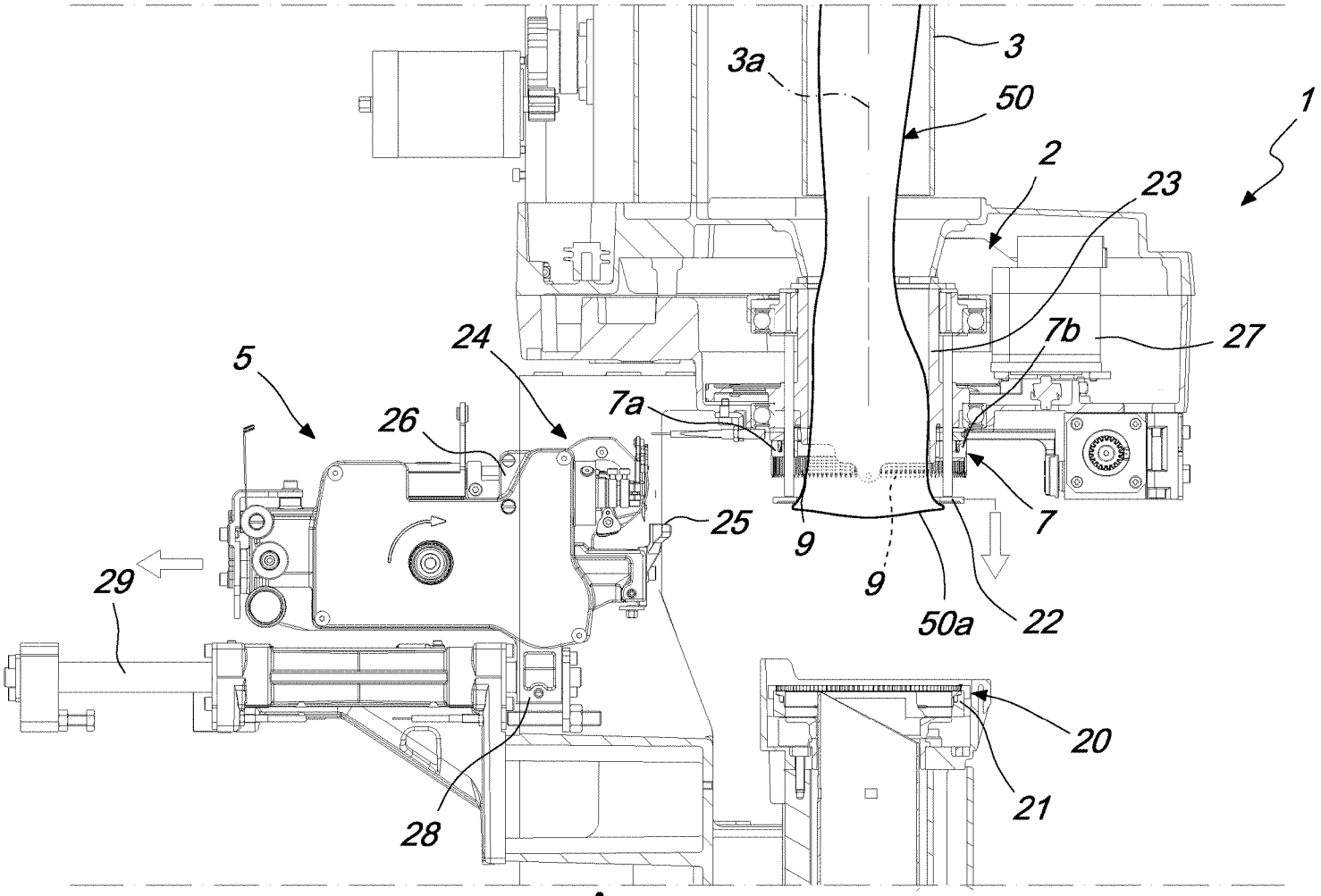
Figure 9:
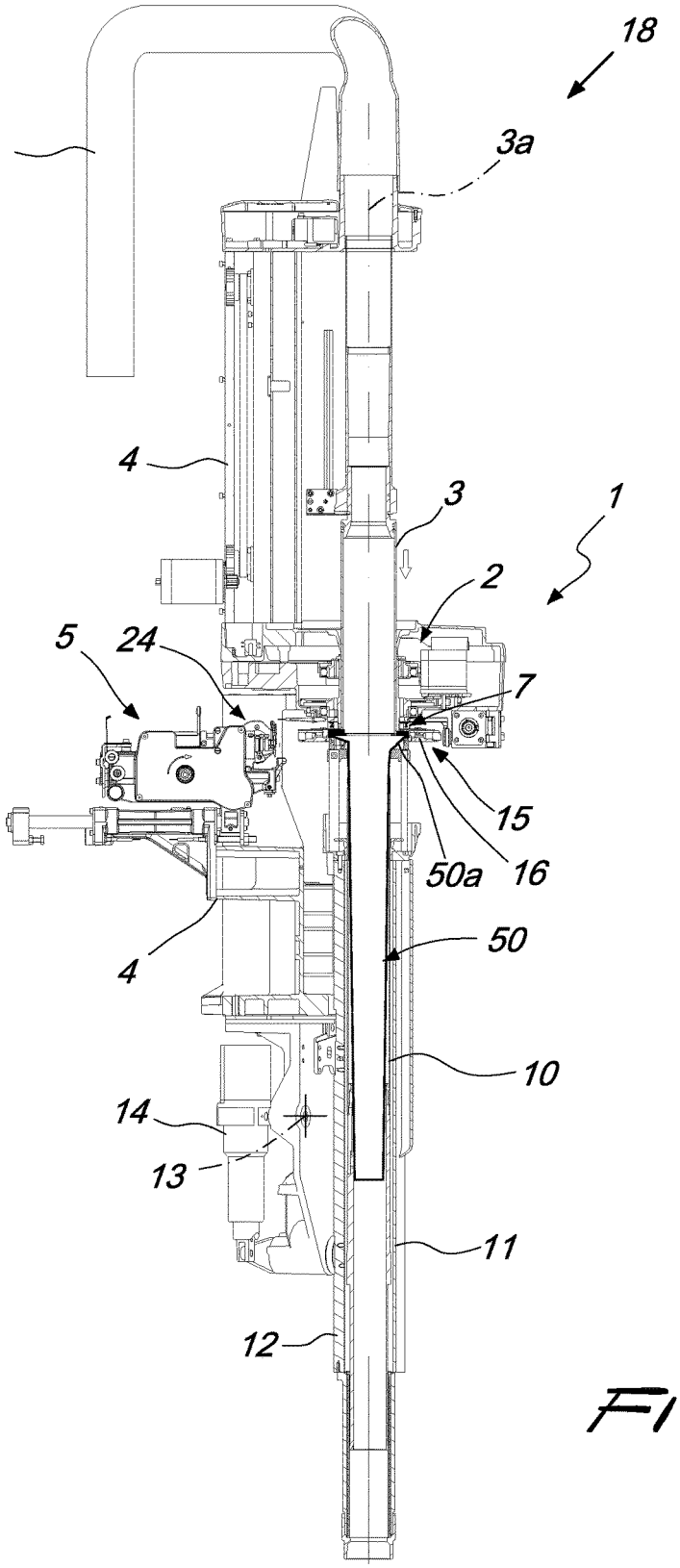
Figure 9A:
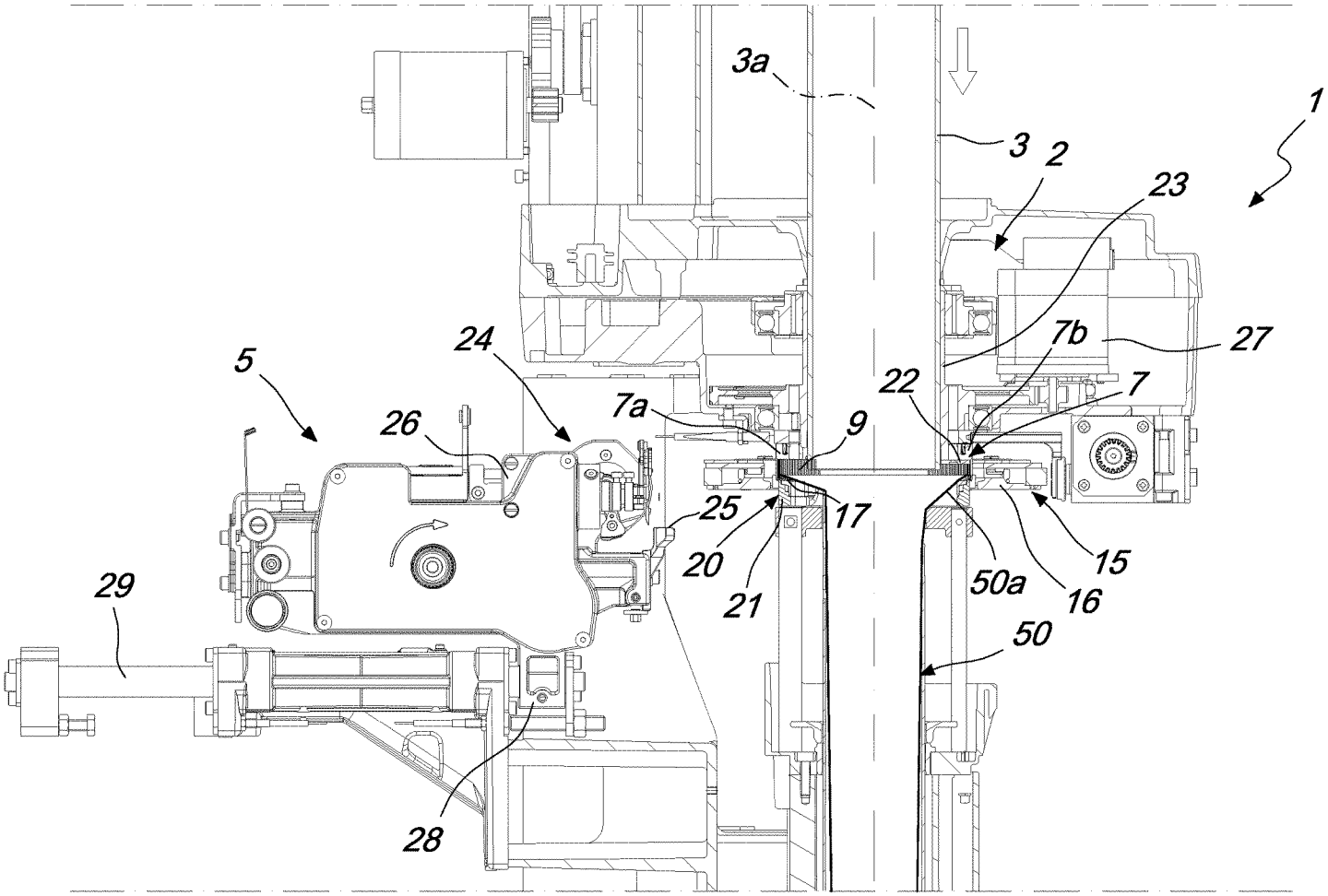
Figure 10:
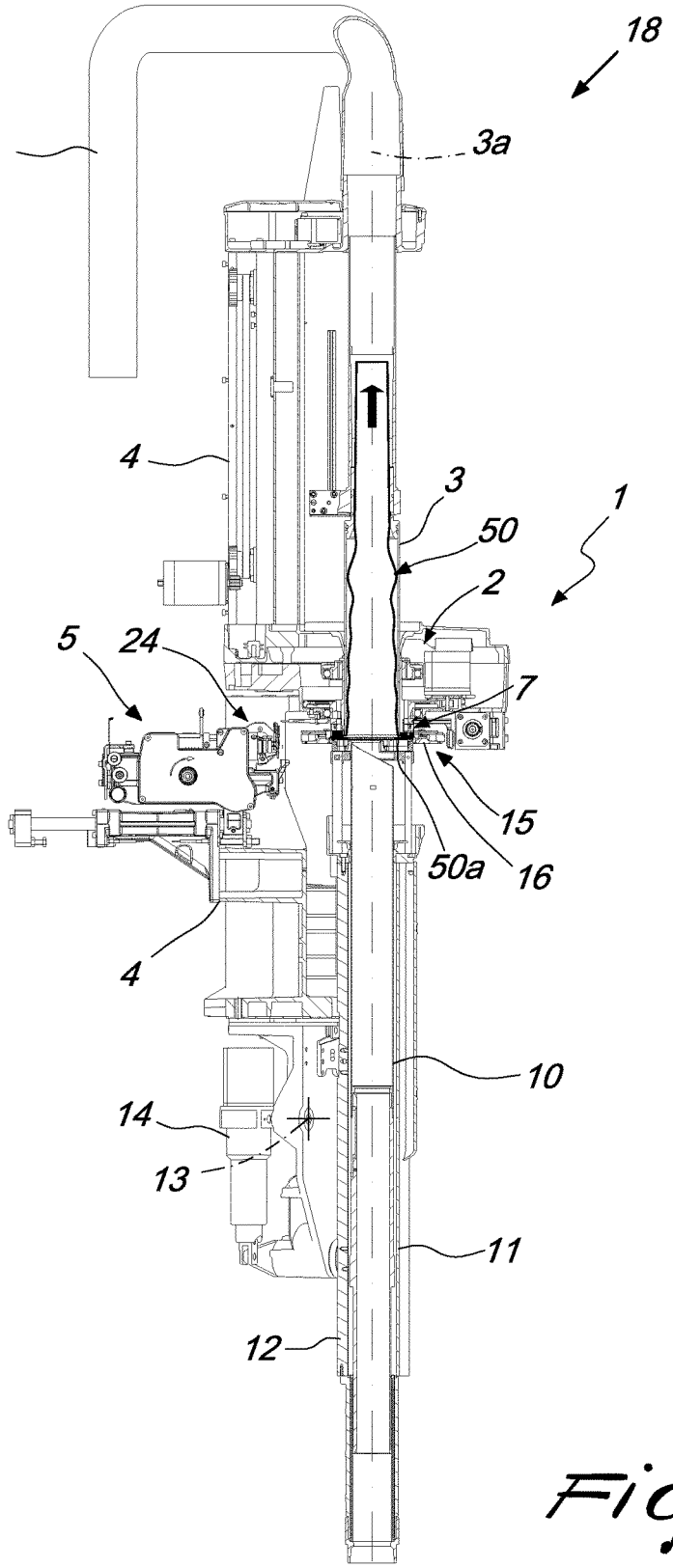
Figure 10A:
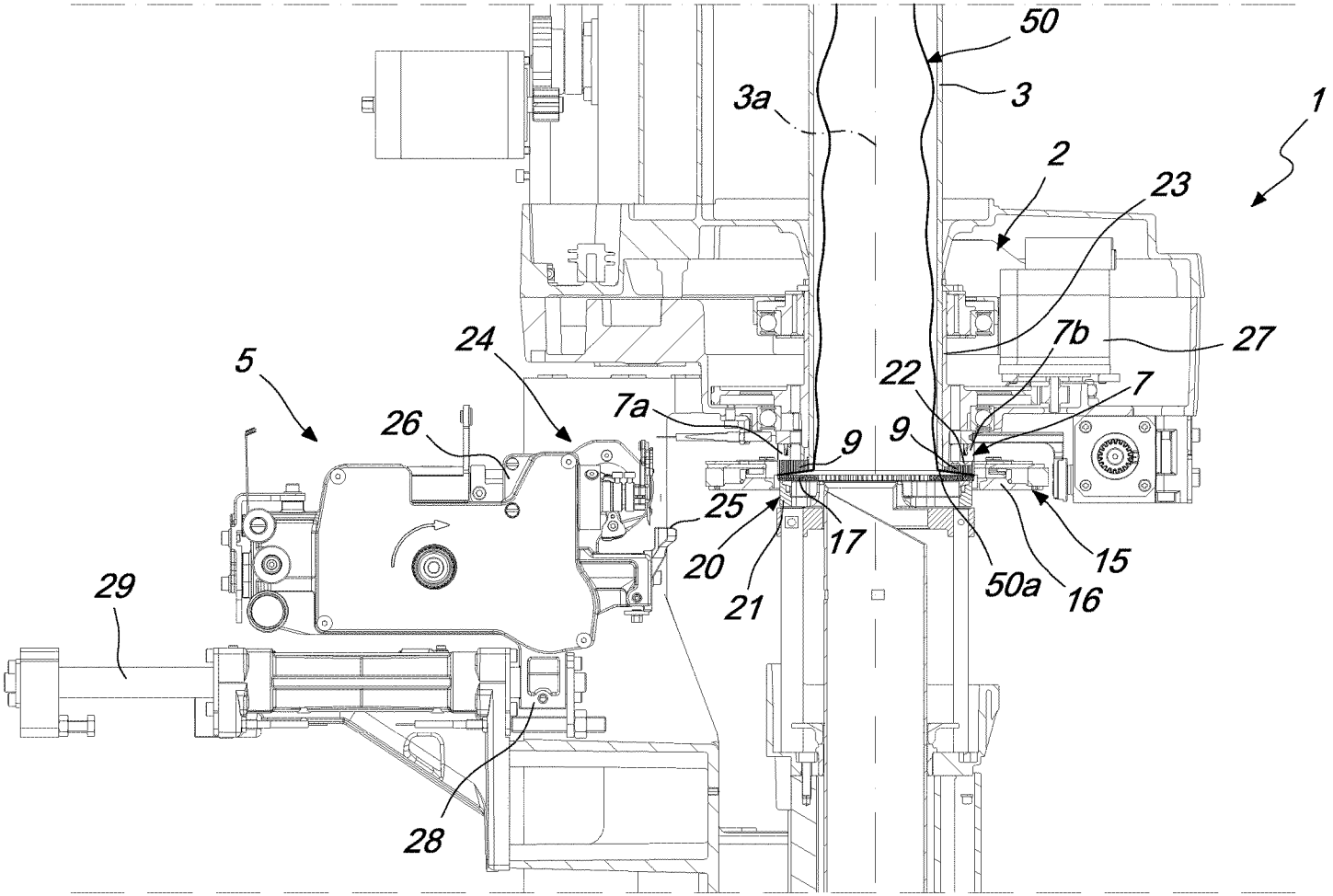

Further characteristics and advantages of the invention will become more apparent from the description of a preferred but not exclusive embodiment of the method according to the invention, as well as of the apparatus for performing the method, illustrated by way of non-limiting example in the accompanying drawings, wherein:

FIGS. 1 to 8 are schematic views of the sequence of steps of the method according to the invention, with the apparatus for performing the method shown schematically and in cross-section along a vertical plane;

FIG. 1*a* is a view of an enlarged-scale detail of FIG. 1;

FIG. 2*a* is a view of an enlarged-scale detail of FIG. 2;

FIG. 3*a* is a view of an enlarged-scale detail of FIG. 3;

FIG. 4*a* is a view of an enlarged-scale detail of FIG. 4;

FIG. 5*a* is a view of an enlarged-scale detail of FIG. 5;

FIG. 6*a* is a view of an enlarged-scale detail of FIG. 6;

FIG. 7*a* is a view of an enlarged-scale detail of FIG. 7;

FIG. 8*a* is a view of an enlarged-scale detail of FIG. 8;

FIGS. 9 and 10 are views of two variations of the steps of the method shown in FIGS. 4 and 5;

FIG. 9*a* is an enlarged-scale view of a detail of FIG. 9;

FIG. 10*a* is an enlarged-scale view of a detail of FIG. 10.

With reference to the cited figures, an apparatus for performing the method according to the invention, generally designated by the reference numeral 1, comprises: a handling device 2, which can engage a first axial end 50*a* of the manufacture 50 to be closed by sewing or linking, at least one upper reversing tube 3, which is supported by a supporting structure 4 above the handling device 2, and means 5 for sewing or linking the first axial end 50*a* of the manufacture 50, which can be operated on command in order to close said first axial end 50*a* of the manufacture 50 that is engaged with the handling device 2.

The upper reversing tube 3 preferably has a straight extension, is preferably arranged so that its axis 3*a* is vertical and can be moved on command along its axis 3*a* in relation to the supporting structure 4. The movement of the upper reversing tube 3 along its axis 3*a* can be obtained, for example, by supporting the upper reversing tube 3 so that it can slide along guides that have a vertical axis and are fixed to the supporting structure 4 and by providing an actuator, for example a fluid-operated cylinder or a screw-and-nut connection operated by an electric motor, that actuates the upper reversing tube 3 so as to translate it along said guides.

The upper reversing tube 3 is connected, with its upper axial end, to a duct 6 that can be connected to suction means of a known type, which are not illustrated for sake of simplicity.

Preferably, the handling device 2 comprises an annular body 7 composed of two annular portions 7*a*, 7*b* that are pivoted to each other about a diametrical axis 8. Under one operating condition, as will become more apparent hereinafter, the two annular portions 7*a*, 7*b* are substantially coplanar and are preferably arranged on a substantially horizontal plane. The annular body 7 is provided with a plurality of spikes 9 that are distributed around the axis of the annular body 7 along its entire circumferential extension. These spikes 9, when the two annular portions 7*a*, 7*b* are coplanar, are oriented parallel to the axis of the annular body 7 and their tip is directed downward. Each one of these spikes 9 can engage a loop of knitting of a row of knitting of the manufacture 50 arranged proximate to, or at, the first axial end 50*a* of the manufacture 50 to be closed by sewing or linking. One of the two annular portions 7*a*, 7*b*, which is constituted in the illustrated case by the annular portion 7*b*, can rotate with respect to the other annular portion about the diametrical axis 8 so as to pass from the coplanar position to a reversed position in which it faces in a downward region the other annular portion 7*a*. In this reversed position, the annular portion 7*b* arranged in a downward region has its spikes 9 with the tip directed upward and faces a corresponding spike 9 of the annular portion 7*a* arranged above. In this position, each spike 9 of the annular portion 7*b* faces and is aligned with a corresponding spike 9 of the other annular portion 7*a*; moreover, each spike 9 of an annular portion 7*a* or 7*b* is in contact, by means of its tip, with the tip of the corresponding spike 9 of the other annular portion 7*b* or 7*a* so that a loop of knitting carried by a spike 9 of one annular portion can be transferred, by sliding, onto the corresponding spike 9 of the other annular portion.

Preferably, the apparatus for performing the method according to the invention comprises also a lower reversing tube 10, which preferably has a rectilinear extension and can be arranged so that its axis is vertical in a coaxial position with respect to the upper reversing tube 3. The lower reversing tube 10 is supported by its own supporting structure or by the same supporting structure 4 that supports the upper reversing tube 3. The lower reversing tube 10 is inserted coaxially into a supporting and guiding tube 11, which is arranged below the handling device 2 and is connected to the supporting structure 4. More particularly, the supporting and guiding tube 11 is inserted in a lower frame 12 that can be pivoted to the supporting structure 4 about a horizontal axis 13 located in an intermediate region of the longitudinal extension of the supporting and guiding tube 11, so that it can be inclined laterally, for example by operation of a linear actuator 14, so as to move the upper end of the supporting and guiding tube 11 closer to the circular hosiery knitting machine that produces the manufacture 50 whose axial end 50*a* has to be closed by sewing or linking, in a manner similar to the one provided for the lower part of the reversing device of WO2009/112346, or so as to move the lower reversing tube 10 so that its axis is vertical and coaxial with the upper reversing tube 3 and with the annular body 7 of the handling device 2.

The handling device 2 is served by a pick-up device 15, which has an annular body 16 which supports pick-up elements 17, which can engage the needles of the circular machine that produces the manufacture 50 and are adapted to pick up individually the loops of knitting of the manufacture that are retained on the needles of the machine. The pick-up device 15 can move on command from a pick-up position, in which it is arranged with its annular body 16 coaxially around the needle cylinder of the machine, to a release position, in which it is arranged with its annular body 16 at a sewing or linking station 18, spaced laterally with respect to the machine for producing the manufacture 50, where the apparatus 1 for performing the method according to the invention is arranged.

The pick-up elements 17 are arranged radially around the axis of the annular body 16 of the pick-up device 15 and are mutually angularly spaced around said axis in a manner that corresponds to the angular spacing among the needles of the circular hosiery knitting machine. In the illustrated embodiment, the end of each pick-up element 17 directed toward the axis of the annular body 16 is shaped like a hook with the tip directed upward and can engage a needle of the circular machine, for example in the same way as described in WO2009/112346, in order to pick up, from the corresponding needle, a loop of knitting of the manufacture 50.

The angular spacing of the spikes 9 around the axis of the handling device 2 corresponds to the angular spacing of the pick-up elements 17 around the axis of the pick-up device 15, so that by arranging the annular body 16 of the pick-up device 15 below and coaxially with the annular body 7 of the handling device 2 with the annular portions 7*a*, 7*b* in a coplanar position, each pick-up element 17 is arranged at a corresponding spike 9 in a manner that is suitable to allow the passage of a loop of knitting from a pick-up element 17 to the corresponding spike 9 of the handling device 2.

In the upper end of the lower frame 12 there is a seat that accommodates first axial pusher means 20 constituted by a ring-like body 21 that is arranged coaxially around the lower reversing tube 10. The ring-like body, similarly to what has been described in WO2009/112346, can move in relation to the handling device 2 and to the pick-up device 15 along the axis of the lower reversing tube 10, which coincides with the axis of the annular body 7 of the handling device 2 and with the axis 3*a* of the upper reversing tube 3, so as to pass the loops of knitting from the pick-up elements 17 of the pick-up device 15 to the spikes 9 of the handling device 2.

Conveniently, the handling device 2 comprises means for transferring the loops of knitting carried by the spikes 9 of one annular portion 7*a* to the spikes 9 of the other annular portion 7*b* when they face each other and means for disengaging the manufacture 50 from the spikes 9 of the handling device 2. The means for transferring the manufacture 50 and disengaging it from the handling device 2 comprise second axial pusher means 22, which are accommodated in the annular body 7 of the handling device 2, above the two annular portions 7*a*, 7*b* when they are coplanar, and interact with the spikes 9 of the handling device 2 to pass the loops of knitting from the spikes 9 of one annular portion 7*a* to the spikes 9 of the other annular portion 7*b* when one annular portion 7*b* is reversed below the other annular portion 7*a*, or to disengage the manufacture 50 from the spikes 9 of one annular portion, constituted in the case illustrated by the annular portion 7*b*, after the sewing or linking operation, as will become more apparent hereinafter.

The annular body 7 of the handling device 2 is connected coaxially around a hollow cylinder 23, having a vertical axis, which is supported, so that it can rotate about its own axis, which coincides with the axis 3*a*, by the supporting structure 4. The annular portion 7*a* is fixed to the outer lateral surface of the hollow cylinder 23, while the annular portion 7*b* is pivoted to the hollow cylinder 23 about the diametrical axis 8.

The hollow cylinder 23 and therefore the annular body 7 of the handling device 2 can rotate about the axis 3*a* relatively to the supporting structure 4 due to the action of an electric motor 27, for example in a manner similar to what is described in WO2009/112346.

The apparatus for performing the method according to the invention also comprises a sewing or linking head 24 arranged proximate to the handling device 2.

The sewing or linking head 24 is provided, in a manner known per se, with sewing elements, constituted for example by a needle and a looper or by a needle and a yarn loading tube or by two needles, so as to perform a sewing or linking chain. The sewing or linking head 24 is furthermore provided, proximate to the sewing elements, with a horizontal support 25 intended to support the annular portion 7*b* when it is reversed below the annular portion 7*a* and while is rotated about the axis 3*a* together with the hollow cylinder 23.

The sewing or linking head 24 is provided with an electric motor 26 for actuation of the sewing elements and the actuation of the electric motor 26 is synchronized with the actuation of the electric motor 27 that actuates the annular body 7 of the handling device 2 so that in each instance the needle of the sewing or linking head 24 engages a spike 9 of the annular portion 7*b* that carries a pair of loops of knitting of the manufacture 50, joining them.

The sewing or linking head 24 is provided with a cutter, of the known type and not illustrated for the sake of simplicity, for cutting the sewing or linking chain at the end of the sewing or linking process.

The sewing or linking head 24 is mounted on a slider 28 that is integral with drive shafts 29 which are oriented so that their axes are horizontal and which are supported, so they can slide along their axes, by the supporting structure 4. A linear actuator of a known type, not illustrated for the sake of simplicity, operates on the slider 28, such as for example a fluid-operated cylinder or an electric motor connected to the slider 28 through a screw-and-nut linkage, which causes the translation on command of the slider 28 and therefore of the sewing or linking head 24 toward the axis of the handling device 2 so as to move the sewing or linking head 24 to a position adapted to interact with the spikes 9 of the annular portion or away from the axis of the handling device 2 so as not to obstruct the positioning of the pick-up device 15 in the sewing or linking station 18 and the reversing of the annular portion 7*b* relatively to the annular portion 7*a* about the diametrical axis 8.

Operation of the apparatus described above, in performing the method according to the invention, is as follows.

The manufacture 50, picked up by means of the pick-up device 15 from the circular hosiery knitting machine 18 that produced it, is transferred, by the same pick-up device 15, to the sewing or linking station 18.

The manufacture 50 hangs, with the loops of one of its rows of knitting, preferably with the loops of the last row of knitting formed by the needles of the circular hosiery knitting machine, from the pick-up elements 17.

The handling device 2 is arranged with the two annular portions 7*a*, 7*b* in a coplanar position, waiting for the manufacture 50.

The lower reversing tube 10 is spaced with its upper axial end in a downward region with respect to the handling device 2.

The pick-up device 15 is arranged so as to face in a downward region the handling device 2 (FIGS. 1 and 1*a*) and is then lifted toward the handling device 2 so that each pick-up element 17 engages a spike 9 of the pick-up device 15 (FIGS. 2 and 2*a*).

At this point the ring-like body 21 of the first axial pusher means 20 is lifted toward the pick-up device 15 and the handling device 2 so as to cause the passage of each loop of knitting from a pick-up element 17 to a spike 9 of the handling device 2 (FIGS. 3 and 3*a*).

In this step of the method, the manufacture 50 is in the right-way-out configuration, is arranged so that its axis is substantially vertical and hangs, by means of a first axial end 50*a* to be closed by sewing or linking, from the handling device 2 and extends below the handling device 2.

Preferably, the manufacture 50 is aspirated inside the lower reversing tube 10.

The manufacture 50 is then inserted inside the upper reversing tube 3 so as to cause its transfer into the inside-out configuration with its first axial end 50*a* still engaged with the spikes 9 of the handling device 2.

The insertion of the manufacture 50 inside the upper reversing tube 3 can be performed as illustrated in FIGS. 4, 4*a*, 5, 5*a*. In practice, the lower reversing tube 10, into which the manufacture 50 has been aspirated beforehand, is lifted along its axis so as to pass through the annular body 7 of the handling device 2 and to enter, with a portion starting from its upper axial end, the lower axial end of the upper reversing tube 3 (FIGS. 4, 4*a*, 5, 5*a*). The lifting and the passage of the lower reversing tube 10, which contains the manufacture 50, through the annular body 7 of the handling device 2 turns up the manufacture 50 on the outer lateral surface of the lower reversing tube 10 that is arranged above the handling device 2. In this manner, the manufacture 50 passes to the inside-out configuration. The upper reversing tube 3 is connected to a suction device so as to retain the manufacture 50.

As an alternative, the insertion of the manufacture 50 into the upper reversing tube 3 can be performed as illustrated in FIGS. 9, 9*a*, 10, 10*a*. In practice, the upper reversing tube 3 is lowered along its own axis 3*a* until its lower axial end is proximate to the handling device 2 (FIGS. 9, 9*a*) and is connected to a suction device so as to aspirate the manufacture 50 into it, causing the manufacture 50 to pass through the handling device 2. In this manner, the manufacture 50 passes to the inside-out configuration. Optionally, the passage of the manufacture 50 into the upper reversing tube 3 can be assisted by lifting of the lower reversing tube 10, into which the manufacture 50 was aspirated beforehand, until its upper axial end is proximate to the handling device 2, and by connection of the lower reversing tube 10 to a compressed air line so that it delivers a jet of air through its upper axial end so as to propel the manufacture 50 into the upper reversing tube 3 (FIGS. 9, 9*a*, 10, 10*a*).

Subsequently, the lower reversing tube 10 is lowered, bringing it again inside the supporting and guiding tube 11, while the manufacture 50 is retained, in the inside-out configuration, inside the upper reversing tube 3, which is lifted above the handling device 2, and the pick-up device 15 is moved away from the handling device 2 (FIGS. 6, 6*a*).

In this manner, the manufacture 50 is engaged, by means of its first axial end 50*a* to be closed, with the spikes 9 of the handling device 2 and is retained, in the inside-out configuration, inside the upper reversing tube 3.

With the manufacture 50 in this position, the annular portion 7*b* of the annular body 7 of the handling device 2 is reversed about the diametrical axis 8 and arranged so as to face in a downward region the other annular portion 7*a* so that the spikes 9 of the annular portion 7*b* face and are aligned with the spikes 9 of the other annular portion 7*a*. By actuation of the second axial pusher means 22, the loops of knitting carried by the spikes 9 of the annular portion 7*b* arranged above are transferred to the spikes 9 of the annular portion 7*b* arranged below. In this manner, each spike 9 of the annular portion 7*b* that is arranged below carries two loops of knitting.

The sewing or linking head 24 is then moved closer to the handling device 2 and its sewing elements are actuated synchronously with the rotation of the annular body 7 of the handling device 2 so as to perform progressively the sewing or linking of the loops of knitting carried by the spikes 9. In this manner, the axial end 50*a* of the manufacture 50 engaged with the handling device 2 is closed (FIGS. 7 and 7*a*).

Once the sewing or linking operation has ended, the sewing or linking head 24 is moved away laterally from the handling device 2 and the annular portion 7*b* is returned to the coplanar position with respect to the other annular portion 7*a*. By means of a new actuation of the second axial pusher means 22, the manufacture 50 is disengaged from the spikes 9 and, due to the suction applied to the upper reversing tube 3, is extracted, in the inside-out configuration, from the upper axial end of the upper reversing tube 3 and unloaded outside the apparatus through the duct 6 (FIGS. 8, 8*a*).

It should be noted that although it is preferred that the manufacture 50 be picked up from the production machine and transferred to the spikes 9 of the handling device 2 with a loop of knitting for each spike 9, the pick-up and transfer can be performed also with other methods, such as for example a method that entails gripping the manufacture 50 also at a row of knitting that is not the last row of knitting formed and with multiple loops of knitting for each pick-up element 17 and for each spike 9.

In practice it has been found that the method according to the invention fully achieves the intended aim, since it allows performing the automated closure of an axial end of a tubular manufacture, for example of a hosiery item, and to unload the manufacture in the inside-out configuration so as to make it available for finishing operations in this configuration.

It is important to note that although the manufacture is unloaded in the inside-out configuration, the closing of one of its axial ends by sewing or linking is performed with the manufacture in the inside-out configuration, making the chain of linking or the stitches of sewing practically invisible on the right side of the manufacture and therefore with a fully satisfactory result from an aesthetic point of view.

A further advantage of the method according to the invention is that it can be performed with an apparatus that can be derived, with modifications that are very easy to provide, from apparatuses that are already available, such as for example the apparatus described in WO2009/112346.

The method and the apparatus for performing it, thus conceived, are susceptible of numerous modifications and variations, all of which are within the scope of the inventive concept; all the details may furthermore be replaced with other technically equivalent elements.

In practice, the materials used, as well as the dimensions, may be any according to the requirements and the state of the art.

The disclosures in Italian Patent Application No. MI2013A000050 from which this application claims priority are incorporated herein by reference.

The invention claimed is:

1. A method for closing an axial end of a tubular manufacture and for unloading it in an inside-out configuration, comprising sequentially:

a step of positioning the manufacture, in a right-way-out configuration, at a sewing or linking station, arranged so that an axis of the manufacture is substantially vertical and so that it hangs, by means of a first axial end to be closed by sewing or linking, from an annular handling device, said manufacture extending below said annular handling device;

a step of inserting the manufacture, retained by said annular handling device, inside an upper reversing tube that is or can be positioned, with its lower axial end, above said annular handling device for the passage of the manufacture through said annular handling device, said passage arranging the manufacture in the inside-out configuration;

a step of closing said first axial end of the manufacture by sewing or linking;

a step of disengaging the manufacture from said annular handling device;

a step of removing the manufacture through the upper axial end of said upper reversing tube.

2. The method according to claim 1, wherein said step of inserting the manufacture in said upper reversing tube is performed by performing in sequence the following actions:

arranging the lower axial end of said upper reversing tube, which is arranged so that its axis is substantially vertical, adjacent to said annular handling device;

aspirating the manufacture into said upper reversing tube, causing the manufacture, which hangs with said first axial end thereof from said annular handling device, to pass through said annular handling device;

lifting said upper reversing tube above said annular handling device.

3. The method according to claim 1, wherein said step of inserting the manufacture into said upper reversing tube is performed by performing in sequence the following actions:

aspirating beforehand the manufacture, which hangs with said first axial end from said annular handling device, into a lower reversing tube that is arranged so that its axis is substantially vertical and so that it faces with its upper axial end said annular handling device;

arranging the lower axial end of said upper reversing tube, which is arranged so that its axis is substantially vertical, adjacent to said annular handling device;

aspirating the manufacture into said upper reversing tube, causing the manufacture, which hangs with said first axial end from said annular handling device, to pass through said annular handling device;

assisting the aspiration of the manufacture into said upper reversing tube by means of a pressurized air stream that is dispensed through the upper axial end of said lower reversing tube toward said upper reversing tube;

lifting said upper reversing tube above said annular handling device.

* * * * *